US005122298A

United States Patent [19]

Fry, Jr. et al.

[11] Patent Number: 5,122,298

[45] Date of Patent: Jun. 16, 1992

[54] DISPERSIBLE SMOKE/OBSCURANT FORMING COMPOSITIONS

[75] Inventors: Raymond R. Fry, Jr., Joppa; Werner W. Beyth, Baltimore; Merlin L. Erickson, Perryman, all of Md.

[73] Assignee: The United States of America as represented by the Secretary of the Army, Washington, D.C.

[21] Appl. No.: 642,979

[22] Filed: Jan. 17, 1991

[51] Int. Cl.[5] ..... C09K 3/30

[52] U.S. Cl. ..... 252/305; 89/1.11; 149/87; 102/334; 102/367; 102/368; 102/369; 102/370; 102/513

[58] Field of Search ..... 102/334, 367, 368, 369, 102/370, 513; 252/305; 149/87; 89/1.11

[56] References Cited

U.S. PATENT DOCUMENTS 3,761,929 9/1973 Wyatt ..... 343/18 B
3,975,292 8/1976 Shaffer ..... 252/305
4,100,102 7/1978 Shaffer ..... 252/305
4,484,195 11/1984 Shaffer ..... 343/18 B
4,756,778 7/1988 Deitz et al. ..... 149/108.2
5,034,274 7/1991 Stevens et al. ..... 428/336
5,039,990 8/1991 Stevens et al. ..... 342/12

*Primary Examiner*—Richard D. Lovering
*Assistant Examiner*—N. Bhat
*Attorney, Agent, or Firm*—Anthony T. Lane; Edward Goldberg; Edward F. Costigan

[57] ABSTRACT

A smoke forming composition is provided suitable for being explosively dispersed in projectiles, bombs, grenades and the like munitions which is composed of a mixture of finely divided solid particles of smoke forming material and a liquid component in an amount sufficient to densify the solid particles of smoke forming materials to increase the bulk density thereof as well as reducing the danger of ignition or "flashing" of the smoke forming materials when explosively dispersed.

1 Claim, No Drawings

DISPERSIBLE SMOKE/OBSCURANT FORMING COMPOSITIONS

GOVERNMENT INTEREST

The invention described herein may be manufactured, used, and licensed by or for the Government for Government purposes without payment to me of any royalties thereon.

FIELD OF THE INVENTION

The present invention relates to obscurant munitions and, more particularly, to explosively dispersible smoke/obscurant munitions with increased dispersion efficiency.

BACKGROUND OF THE INVENTION

Projectiles, drop bombs, shells, grenades and the like munitions which are used for explosively dispersing finely divided solid smoke and the like obscurant materials have in the past exhibited limited dispersion efficiency as a consequence of the extremely small size and type of the solid particulate smoke forming materials that are used. Finely divided solid particles of smoke forming materials such as aluminum flake, brass flakes, copper flakes and carbon flakes have a very low bulk density which limits the amount of material that could be charged into the volume limited projectile or the like container as well as the dispersion efficiency that is achieved with such small amounts of finely divided dry, solid particles in the charge. Moreover, certain of the solid particulate materials such as aluminum will ignite and "flash" when explosively dispersed.

Heretofore, attempts to address the problem of producing smoke forming compositions with increased bulk density and dispersion efficiency as well as reducing the "flashing" thereof have not proven to be entirely satisfactory. Mechanical compression of the finely divided smoke forming particles into a pellet or slug to increase the bulk density results in a reduction of the dispersion efficiency of the charge as well as adversely affecting the particle size distribution due to the agglomeration or welding of the particles. Alternatively, increasing the amount of explosive charge improves the dispersion efficiency, but the volume limitations of the projectile and the like containers reduces the amount of solid smoke forming particles that can then be used as well as increasing the danger of ignition or "flashing" of the particulate materials that are used.

SUMMARY OF THE INVENTION

It is, accordingly, an object of the present invention to provide a smoke/obscurant composition composed of densified finely divided solid particles of smoke forming materials which are readily explosively dispersible.

It is another object of the present invention to provide a smoke/obscurant composition of densified finely divided solid particles of smoke forming materials such as particulate metals, carbon and the like of increased bulk density and dispersion efficiency which is readily explosively dispersible, wherein the bulk density is high enough to permit a sufficient amount of said smoke forming particles to be charged into a volume limited container for effecting a smoke and the like obscurant without adversely affecting the particle size distribution of said solid particles and, preferably, without increasing the danger of "flashing" of said solid particle upon the explosive dispersion thereof.

It is a further object of the present invention to provide a substantially homogeneous mixture of finely divided solid particles of smoke forming materials and a liquid component, wherein the bulk density and dispersion efficiency of said mixture is greater than that of a like amount of said solid particles when dry, permitting a larger charge of smoke forming solid particles to be used in a volume limited container, and, preferably, smoke forming materials which will be less likely to ignite or "flash" as a result of the use of an explosive dispersibility agent.

It is a still further object of the present invention to provide a smoke/obscurant composition composed of a substantially homogeneous mixture of finely divided solid particulate smoke forming material and water, a liquid substituted or unsubstituted hydrocarbon of from 1 to 13 carbon atoms or mixtures thereof, having a bulk density greater than that of a similar amount of the dry particulate smoke forming materials, e.g, at least 1 gm/cc, a greater explosive dispersibility efficiency than the dry solid form of said smoke forming materials and a reduced tendency of ignition or "flashing."

It is yet a further object of the present invention to provide a method for forming a smoke forming composition of finely divided solid particles of smoke forming materials having increased explosion dispersibility efficiency by densifying the smoke forming solid particles with a liquid component into a mixture having a bulk density greater than that of a like amount of the dry, solid, smoke forming particles, e.g., at least 1 gm/cc.

In accordance with the present invention there is provided an explosively dispersible smoke and obscurant forming composition comprising a substantially homogeneous mixture of a finely divided solid particulate smoke forming component and a liquid component selected from the group consisting of water, a liquid substituted or unsubstituted hydrocarbon compound having from 1 to 13 carbon atoms and mixtures thereof, said liquid component being present in an amount sufficient to provide an explosively dispersible smoke forming composition having a bulk density greater than the bulk density of a like amount of said finely divided solid particulate smoke forming component when dry.

In another aspect of the invention there is provided a process for forming a densified composition of finely divided solid smoke and obscurant forming particles having increased bulk density, explosive dispersibility and ignition resistance comprising mixing substantially dry finely divided solid particles of smoke forming materials with water, a liquid hydrocarbon compound of 1 to 13 carbon atoms or mixtures thereof to form a substantially homogeneous mixture.

Other objects and advantages of the present invention will become apparent from the detailed description and examples thereof which follow.

DETAILED DESCRIPTION OF THE INVENTION

The composition of the present invention comprises a substantially homogeneous mixture of finely divided solid smoke forming particulate material and a liquid component selected from the group consisting of water, a liquid substituted or unsubstituted hydrocarbon having from 1 to 13 carbon atoms and mixtures of the same, wherein the finely divided smoke forming particles are densified to form a smoke/obscurant forming composition. The mixture has an increased bulk density compared to the bulk density of a like amount of the dry smoke forming solid particles without agglomerating or fusing the finely divided smoke forming particles, and the smoke forming particles in the composition exhibit an increased dispersion efficiency compared to the dry smoke forming particles when explosively dispersed by projectile, drop bombs, grenades and the like munitions as well as a reduced tendency to ignite or "flash" during such use.

In a typical smoke/obscurant forming composition in accordance with the present invention, a variety of metals, carbon and the like materials in the form of finely divided, solid particles, all of which are known in the art, may be utilized. Such materials are used in the form of solid, finely divided powders, particles, flakes and the like. Exemplary suitable materials include aluminum flakes, copper flakes, brass flakes and carbon flakes. Suitable finely divided solid particles or the like smoke forming materials may be prepared by conventional well known techniques. The particle size and particle size distribution of the smoke forming materials can vary depending on the material used as well as the method of their preparation, as is known in the art.

Liquids or fluids which are useful as the liquid component in the practice of the present invention are water and a liquid substituted or unsubstituted hydrocarbon of 1 to 13 carbon atoms including hydrocarbons having from 4 to 13 carbon atoms such as hexane, heptane, octane, nonane; lower alcohols such as methanol, ethanol, propanol; higher alcohols; chlorinated hydrocarbons such as carbon tetrachloride, trichlorethane, freon 113 and the like. Also suitable are acetone, kerosene, mineral spirits and silicone fluid.

The proportions of liquid component and dry particulate smoke forming component used in the smoke forming compositions of the invention will generally depend on the amount of smoke forming material required for use in a particular munitions projectile and the like container and can vary depending on the type of liquid and solid particulate materials used. Typically, the liquid component is used in an amount sufficient to densify the particles of the finely divided solid smoke forming material and achieve a suitable increase in the bulk density, e.g., the bulk density of dry brass flakes of 0.8 gms/cc is increased to 2.5 gms/cc, without agglomeration or fusion thereof or otherwise adversely affecting the dispersion efficiency. In general, the composition of the invention may contain as much as 60% by weight of the liquid component can be used, or in an amount sufficient to form a homogeneous mixture wherein the solid particles are uniformly dispersed and liquid does not separate therefrom.

Compositions of the invention may be prepared by any conventional method wherein, for example, the liquid component can be added to the dry solid particles by conventional means including sprinkling and the like and the admixture is blended for the time necessary to form a homogeneous mixture, or the solid particles may be added to the liquid component with suitable blending of the admixture. After the liquid and solid particle components are mixed, the admixture can be permitted to stand to effect settling and wetting of the solid particles and. thus, achieve the maximum densification of the composition. Compaction of the mixture may also be useful to further increase the bulk density of the composition, but the compression forces used should not be so high as to agglomerate or fuse the particles. If excess liquid component is added, after standing and settling of the mixture, the excess liquid component can be dried.

Although the smoke/obscurant forming compositions of the invention have been illustrated in the foregoing detailed description, it should be appreciated that other variations may be made. Accordingly, the invention is not intended to be limited to the specific embodiments or examples set forth in the specification, but rather is limited only by the appended claims.

What is claimed is:

1. An explosively dispersable smoke and obscurant forming composition consisting essentially of (a) substantially homogeneous mixture of a finely divided solid particulate smoke forming component selected from the group consisting of brass flakes, copper flakes, and carbon flakes and (b) a liquid component selected from the group consisting of liquid hydrocarbons having four to thirteen carbon atoms, lower alcohols, chlorinated hydrocarbons, silicon fluid and mixtures thereof, said liquid component being present in the amount of about 60 percent by weight of said mixture, to form an explosively dispersable smoke forming composition having a bulk density of at least one gram per cubic centimeter.

* * * * *